United States Patent [19]

Won

[11] Patent Number: 4,582,255

[45] Date of Patent: Apr. 15, 1986

[54] SELF-PROPELLED, FLOATING, ROTARY, LIQUID ATOMIZER

[76] Inventor: Vann Y. Won, 6697 Gloria Dr., Sacramento, Calif. 95831

[21] Appl. No.: 689,737

[22] Filed: Jan. 8, 1985

[51] Int. Cl.[4] ..... B05B 3/04; B05B 3/10

[52] U.S. Cl. ..... 239/222.19; 239/223; 239/261

[58] Field of Search ..... 239/214, 214.13, 214.15, 239/214.21, 222.11, 222.17, 222.19, 223–225, 261, 380, 381; 415/92, 202

[56] References Cited

U.S. PATENT DOCUMENTS

| | | | |
|---|---|---|---|
| 662,236 | 11/1900 | Johnston . | |
| 2,408,511 | 10/1946 | Gothard | 239/222.19 |
| 2,815,246 | 12/1957 | Nyrop . | |
| 2,836,464 | 5/1958 | Dickinson . | |
| 3,081,949 | 3/1963 | Simmons | 239/383 |
| 3,125,297 | 3/1964 | Copeland et al. | 239/261 |
| 3,659,957 | 5/1972 | Yuen | 416/179 |
| 4,044,081 | 8/1977 | Weidlich | 261/51 |
| 4,222,523 | 9/1980 | Bals | 239/216 |

FOREIGN PATENT DOCUMENTS

| | | | |
|---|---|---|---|
| 155040 | 6/1938 | Fed. Rep. of Germany | 239/261 |

*Primary Examiner*—Andres Kashnikow

*Assistant Examiner*—MaryBeth O. Jones

*Attorney, Agent, or Firm*—Donald J. Singer; Jacob N. Erlich

[57] ABSTRACT

A self-propelled, floating, rotary, liquid atomizer having a feed tube and a free floating rotor operably connected at the bottom thereof. The feed tube is hollow and is affixed to the inlet line of a pressurized liquid source. This liquid source is not only atomized but serves as the motor force for the atomizer as well as lifts the rotor off its support to become free floating. A plurality of slits are formed adjacent the bottom of feed tube and they are juxtaposed a plurality of cup-like openings and holes formed in the rotor. As the liquid under pressure is passed through the feed tubes it exits from the slits at the bottom of the feed tube and impinges upon the upper edges of the cup-like openings within the rotor to cause the rotor to lift from its support coincidental to rotation thereof. This high speed rotation causes the free-floating rotor to act as a fly wheel spinning at such high speed that it increases the momentum of the liquid forcing it up and along the walls of the rotor and out through both the top and bottom of the openings therein. As the liquid reaches the openings at the top and bottom of the rotor, it is sheared into fine droplets and sprayed/atomized at 360° around the rotor.

7 Claims, 2 Drawing Figures

SELF-PROPELLED, FLOATING, ROTARY, LIQUID ATOMIZER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to an apparatus for atomizing liquids, and, more particularly, to a liquid atomizer which is self-propelled and capable of operating extremely efficiently under a wide variety of conditions such as in a vacuum or under sub-ambient pressure conditions.

There are many instances when it becomes necessary to physically separate a substance from a liquid in which it is mixed or in which it is contained. For example, a nonvolatile liquid such as hydraulic fluid, which is used in the hydraulic test stands of aircraft repair systems, becomes unserviceable when the chlorine content thereof reaches 50 parts per million. The source of the chlorine within the hydraulic fluid is found in the chlorinated solvents which are used within the aircraft repair system for cleaning and/or degreasing on the test stands. These chlorinated solvents are extremely volatile while the hydraulic fluid, as stated above, is nonvolatile.

Although distillation procedures have been used in the past for the separating of such liquids it has been recognized by the inventor, as exemplified in U.S. Pat. No. 4,432,775 issued to this inventor on Feb. 21, 1984, that the utilization of an atomization technique, in which the substance can be atomized to form a fine mist in a low pressure (vacuum) environment in order to easily withdraw or separate this fine mist or vapor from the liquid, is feasible. Such an atomization system incorporates therein an atomizer of the type set forth by this inventor (formerly known as Yuen) in U.S. Pat. No. 3,659,957 issued May 2, 1972, or with appropriate modification incorporates therein the type of atomizer described in U.S. patent application Ser. No. 493,885 filed on May 12, 1983 by the present inventor, or the type of atomizer set forth in U.S. patent application Ser. No. 689,738 entitled SELF-PROPELLED, ROTARY, LIQUID ATOMIZER filed on the same date as this invention also by the present inventor.

Although the type of atomizers disclosed in the above-mentioned U.S. Pat. No. 3,659,957 and U.S. patent application Ser. No. 493,885 are operational in vacuum or under sub-ambient pressure conditions, it is desireable to find alternative atomizers which are more effective and reliable in separating a volatile substance from a nonvolatile liquid in a vacuum or under sub-ambient pressure conditions. More specifically, the atomizer set forth in the above-identified U.S. patent application Ser. No. 689,738 was developed to overcome that type of problems. Even though such an atomizer provides desirable atomization even in a vacuum or under sub-ambient pressure conditions, even more efficient atomization would be desirable. Consequently, further development of an improved atomization unit would be desirable.

SUMMARY OF THE INVENTION

The present invention substantially modifies the atomizer described in U.S. patent application Ser. No. 689,738 entitled SELF-PROPELLED, ROTARY, LIQUID ATOMIZER, by providing a system less constrained by friction as well as providing an increased atomization capacity.

The present invention replaces the motive power for past atomizers, generally in the form of an electric motor, with the liquid itself by incorporating therein a novel construction of the atomizer. In addition, the free floating atomizer design of the present invention substantially reduces friction between parts and enables the invention to provide a greater atomization capability. Consequently the atomizer of the present invention is in the form of a self driven, floating, rotary, liquid atomizer.

Making up the present invention are three main components: (1) a feed tube, (2) a free floating, rotating dispersion cylinder or rotor, and (3) a pressurized liquid source. The feed tube is in the form of a hollow shaft which does not rotate and through which the liquid is fed under pressure. The fluid leaves this feed tube through a plurality of slits located adjacent the bottom end of the tube. The flow rate of the fluid or liquid exiting these slits can be varied by either varying the fluid flow rate itself entering the shaft or by altering the size of the exit slits at the end of the feed tube or shaft. In such a manner the desired fluid velocity through these exit slits can be controlled. This desired velocity will vary in accordance with the viscosity and the temperature of the liquid to be atomized.

Once the fluid leaves the exit slits of the feed tube at a preferred optimum angle of impingement this fluid impinges on a series of cup-like openings situated in the second part or free floating, rotating dispersion cylinder of the invention. The rotating dispersion cylinder is interconnected to the feed tube by means of a uniquely designed free floating arrangement. This arrangement encompasses a ball-bearing assembly which is rotatably secured to the bottom or closed end of the feed tube. The free floating dispersion cylinder or rotor in its non-rotating or inoperative position rests upon the ball-bearing assembly. By the appropriate application of the pressurized fluid or pressurized liquid to these cup-like openings in the rotating dispersion cylinder, the unique design of the cylinder enables the cylinder to initially spin or rotate with this ball bearing assembly and thereafter disengage from the ball bearing assembly lifting freely therefrom and rotate in a substantially friction free manner about the feed tube. Such an action can be described as free-floating rotation.

As a result of the substantial high speed of rotation, the rotor is designed such that as the liquid exhausts its energy of momentum at the walls of the cup-like openings, it is redirected to both the top and bottom of the openings. In this redirection, the liquid layers of the fluid are sheared over one another causing the fluid to emerge as a mist from both the top and bottom of the openings in a similar type of atomization procedure as set forth and described in detail within U.S. Pat. No. 3,659,957.

With the self-propelled, floating, rotary, liquid atomizer of the present invention, atomization can take place extremely effectively and reliably in a vacuum or under sub-ambient pressure conditions. The only source or mode of power for the atomizer is in the pressurized liquid itself. Since the liquid source is attached directly to the feed tube of the present invention there are no intervening components and the liquid always remains under pressure even in vacuum.

It is therefore an object of this invention to provide an apparatus for extremely efficiently separating a substance from a liquid in which it is contained while in a vacuum or under sub-ambient pressure conditions.

It is still another object of this invention to provide an apparatus for efficiently separating a substance from a liquid in which the mode of force for operating the apparatus is derived directly from the liqud itself.

It is still a further object of this invention to provide a self-propelled, floating, rotary, liquid atomizer which is capable of increasing its atomization capacity, and therefore be incorporated in a wide variety of atomization systems.

It is still a further object of this invention to provide a self-propelled, floating, rotary, liquid atomizer which is economical to produce and which utilizes conventional, currently available components that lend themselves to standard mass producing manufacturing techniques.

For a better understanding of the present invention, together with other and further objects thereof, reference is made to the following description taken in conjunction with the accompanying drawings and its scope will be pointed out in the appended claims.

DETAILED DESCRIPTION OF THE PREFERRED EMBODIMENT

Figure 1:
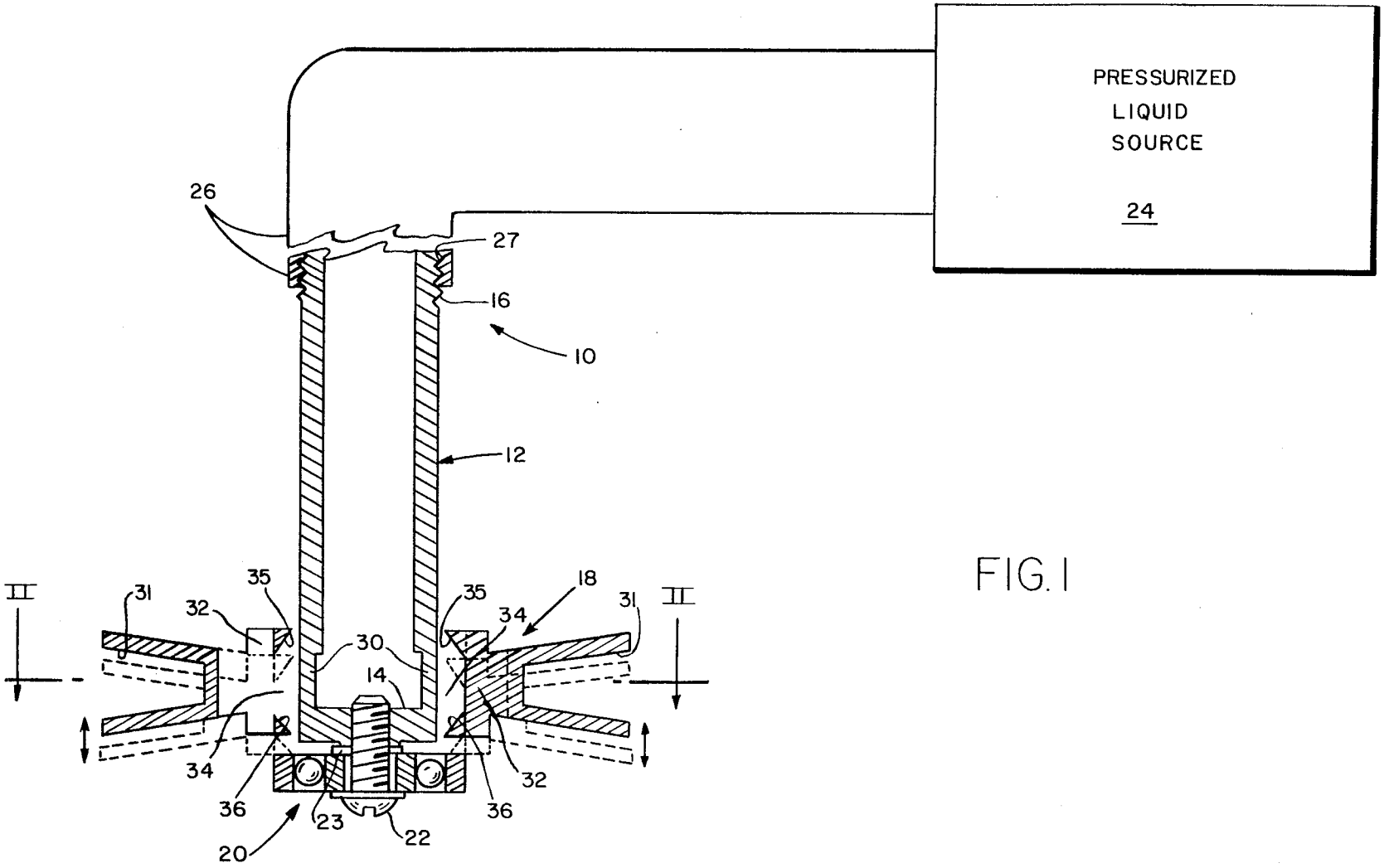
FIG. 1 is an enlarged, side elevational view of the self-propelled, floating, rotary, liquid atomizer of the present invention shown partly in cross section.

Reference is now made to FIG. 1 of the drawings which clearly illustrates the major components making up the self-propelled, floating, rotary, liquid atomizer 10 of the present invention. Atomizer 10 of the present invention includes a hollow, elongated shaft or feed tube 12 closed at one end 14 and externally threaded at the other end 16 thereof. Non-fixedly or free floatingly attached (in a manner described in greater detail below) to the bottom end 14 of feed tube 12 is an annular-shaped rotatable dispersion cylinder or rotor 18. A ball bearing assembly 20, upon which the rotor 18 rests (as illustrated in phantom in FIG. 1 of the drawings) during its nonoperational state, is rotatably secured to the bottom 14 of feed tube 12. As a result of this free floating arrangement, rotor 18 can freely rotate about feed tube 12 under the influence of a pressurized liquid source in a manner to be described in detail hereinbelow. Any suitable bolt 22 affixes the ball bearing assembly 20 to the bottom 14 of feed tube 12 as illustrated in FIG. 1. A washer 23 is positioned between the bottom of feed tube 12 and the inner race of ball bearing assembly 20 to aid in the reduction of friction therebetween.

The remaining component making up the present invention is a source of pressurized liquid 24 which is fed by means of inlet line 26 into the hollow portion of feed tube 12. Line 26 is internally threaded at end 27 so that feed tube 12 may threadably engage therewith. With such an arrangment as set forth in the present invention line 26 also acts as the support for the self-propelled, floating, rotary, liquid atomizer 10 as well as a means of introducing the pressurized liquid into feed tube 12 in order to provide the motive force for atomizer 10.

Figure 2:
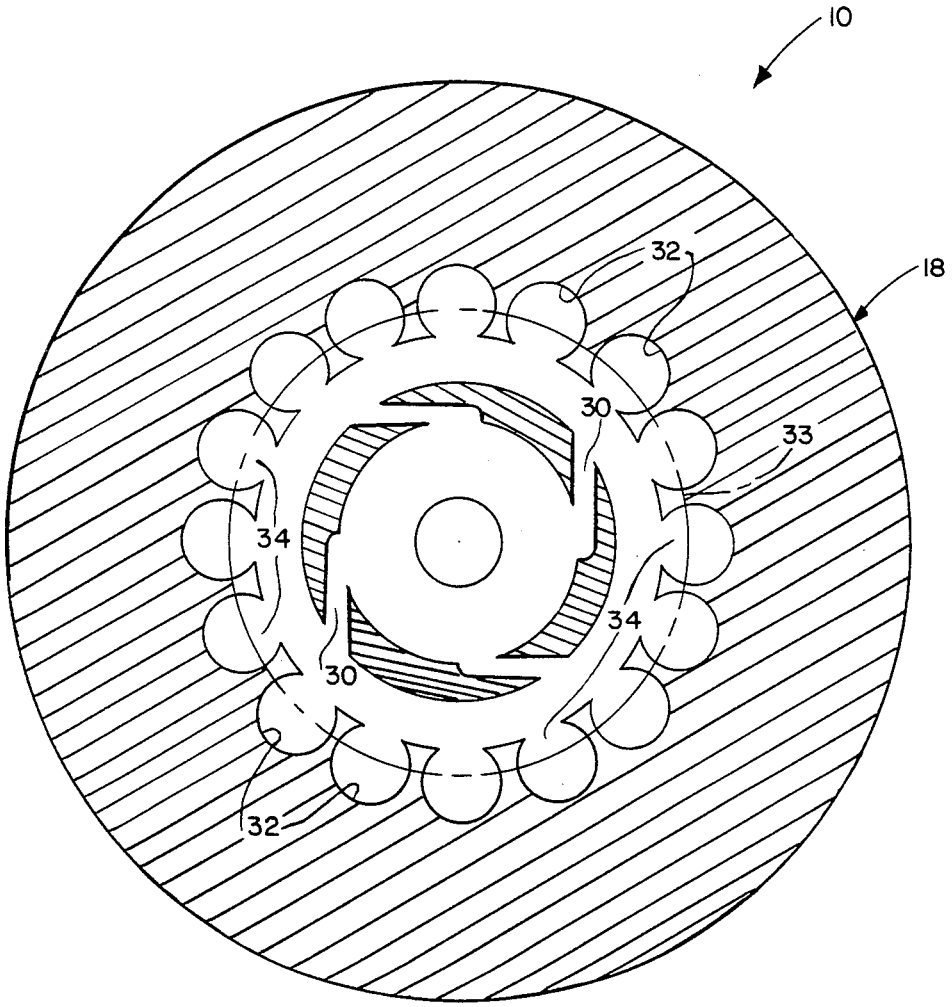
FIG. 2 is a cross sectional view of the self-propelled, floating, rotary, liquid atomizer of the present invention taken along lines II—II of FIG. 1.

Reference is now made to FIGS. 1 and 2 of the drawings for a more detailed description of the actual physical construction of feed tube 12, rotor 18 and ball bearing assembly 20. As clearly shown in FIG. 2 of the drawings, feed tube 12 has located at the bottom thereof a plurality (preferably 4 in number) of slits 30. These slits 30 are formed by precisely cutting, by an arc-electro discharge process, openings within the side wall of feed tube 12. These openings or slits 30 are generally 1/32 inch in width and extend approximately $\frac{1}{8}$ inch in height. Depth for the slits 30 are generally $\frac{1}{2}$ inch. Slits 30 are configured so as to be formed tangential to the circumference of the inside wall surface of feed tube 12. In this manner they are situated 90° along a radius drawn from the center of feed tube 12. Such a configuration adjacent the bottom of feed tube 12 enables the liquid under pressure to be forced through slits 30 in order to act as the motivating force in rotating and lifting rotor 18 in a manner to be described hereinbelow.

Still referring to FIGS. 1 and 2 of the drawings, rotor 18 is shown in the form of an annular ring, preferably made of metal, and as stated above, which rests upon ball bearing assembly 20 when the atomizer 18 is not in operation. Upon the application of pressurized liquid from slits 30, rotor 18 initially rotates with ball bearing assembly 20 until sufficient force has been applied to lift rotor 18 above ball bearing assembly 20 in a manner set out in greater detail below. In addition, since rotor 18 is free floating, extra material is cut out at 31 in the outer periphery thereof in order to decrease the weight of rotor 18 and permit its lifting from ball bearing assembly 20 to take place more easily.

More specifically, rotor 18 has a plurality of circumferentially-spaced holes 32 of approximately $\frac{1}{8}$ inch diameter and preferably 16 in number drilled therethrough. Holes 32 are open both at the top and bottom surfaces of rotor 18 and have their centers lying along a circle 33 having a diameter of approximately $\frac{3}{4}$ inch. As shown in FIG. 1 of the drawings, these holes 32 are drilled substantially vertically and are spaced approximately 22.5° apart (see FIG. 2).

At approximately the mid level of rotor 18 and as shown in FIGS. 1 and 2 of the drawings, cut-outs 34 are formed for a height of approximately $\frac{3}{4}$ inch to create inside openings 34 of approximately 1/16 inch width within the walls of holes 32. It is essential that these openings 34 face slits 30 of feed tube 12 and be of substantially the same height. In addition, it is critical that top and bottom edges 35 and 36, respectively, are formed adjacent cut-outs or openings 34 at an angle, preferably of approximately 45°. This is essential since the impinging pressurized liquid from slits 30 will, when rotor 18 is at rest, strike the upper slanted edges 35 and lift rotor 18 off ball bearing assembly 20 substantially simultaneously with entering holes 32 of rotor 18.

Rotor 18 will rise above ball bearing 20 until slits 30 and cut-outs 34 are aligned. This alignment is maintained because of the slant of edges 35 and 36. If the rotor 18 rises too high above ball bearing 20, pressurized liquid striking edges 36 acts to lower rotor 18, on the other hand, if rotor 18 falls toward ball bearing 20, pressurized liquid striking edges 35 acts to raise rotor 18. In this manner as long as sufficient pressurized liquid is available rotor 18 is self-adjusting and slits 30 will maintain its align with cut-outs 34. Cut-outs 34 together with holes 32 form a cup-like configuration which act as a turbine configuration in order to produce optimum rotor speed during rotation thereof under the influence of pressurized liquid.

As the pressurized liquid from source 24 enters the hollow feed tube 12 it is forced down tube 12 and through the slits 30 against edges 35 of the cup-like configured holes 32 in order to not only lift rotor 18 from its resting position on ball bearing assembly 20, but also to rotate rotor 18 about feed tube 12. Because of the free floating arrangement of rotor 18 (that is, virtually no friction), rotor 18 is capable of reaching extremely rapid speeds. This rotation allows for atomization of the liquid to take place so efficiently that the liquid is dispersed in a fine globular spray both from the top and bottom of holes 32 in rotor 18. The above dimensions are provided to illustrate an operational atomizer 10, however, it should be realized that these dimensions may be varied within the scope of the present invention.

MODE OF OPERATION

In operation, the liquid to be atomized is pumped by means of any conventional pumping means associated with liquid source 24 into feed tube 12 through line 26. Optimum results can be obtained at a liquid feed rate of approximately 3 gallons per minute. Under such conditions, the liquid is forced out of the four slits 30 at the bottom of feed tube 12. This pressurized liquid not only acts as a motive force to rotate rotor 18, but also acts as a lifting force to raise rotor 18 above ball bearing assembly 20. Theoretically, liquid exits slits 30 at a linear speed of approximately 3696 feet per minute as calculated in the following manner:

| | |
|---|---|
| 1 gallon = 231 $in^3$ | volume conversion |
| (3 gallons) (231) = 693 $in^3$ | volume of liquid |
| $\frac{693\ in^3}{(4)(1/32'')(\frac{1}{8}'')} = 44352$ in/min $= 3696$ ft/min | speed flow |

As the liquid exits slits 30 it strikes the cup-like configured holes 32 causing rotor 18 to spin with virtually no friction at approximately 19000 rpm as calculated below:

| | |
|---|---|
| $\frac{44352}{(\frac{3}{4}'')(\pi)} = 18824$ rpm | rotation speed of atomizer |

Because the present invention virtually eliminates friction between rotor 18 and feed tube 12, speeds which approach the above theoretical speed of 19000 rpm may be attainable. Since the rotor 18 acts as a fly wheel, spinning at such extremely high speed increases the momentum of the liquid, forcing it upward as well as downward along the walls surrounding holes 32 of rotor 18. As the liquid reaches the top and bottom, respectively, of holes 32 of rotor 18, it is sheared into fine droplets and sprayed/atomized in 360° circle around rotor 18 both at the top and bottom thereof. It is clear from the unique design of the present invention that the liquid to be atomized is therefore more efficiently atomized than with past devices while still remaining completely unaffected by the surrounding conditions, that is, vacuum or under sub-ambient pressure conditions.

Althou9h this invention has been described with reference to a particular embodiment, it will be understood that this invention is also capable of further and other embodiments within the spirit and scope of the appended claims.

I claim:

1. A self-propelled, floating, rotary, liquid atomizer, comprising:

means for providing a source of liquid under pressure;

a feed tube operably connected at one end to said pressurized liquid source, said feed tube including an elongated structure having a hollow interior surrounded by a side wall and closed at the other end thereof, and a plurality of slits of predetermined size in said side wall adjacent said closed end for permitting said pressurized liquid to pass therethrough;

means encompassing said closed end of said feed tube for rotation therearound, for receiving said pressurized liquid from said slits and for dispersing said liquid therefrom in the form of a fine globular spray; said receiving and dispersing means including a plurality of circumferentially spaced-apart holes through which said liquid is dispersed and each of the side walls of said holes being partially cut-out and having upper and lower edges adjacent said cut-out, said cut-outs being of a size substantially equal to said predetermined size of said slits; and means rotatably secured to said closed end of said feed tube for supporting said receiving and dispersing means when said receiving and dispersing means is at rest;

whereby upon the passing of said pressurized liquid from said slits, said pressurized liquid impinges upon said upper edges of said receiving and dispersing means to raise said receiving and dispersing means above said supporting means such that continued pressurized liquid not only acts upon said upper and lower edges to maintain said receiving and dispersing means above said supporting means, but also acts as the motive force to rotatably drive said receiving and dispersing means thereby causing atomization of said liquid to take place.

2. A self-propelled, floating, rotary, liquid atomizer as defined in claim 1 wherein said supporting means comprises a ball bearing assembly rotatably secured to said closed end of said feed tube.

3. A self-propelled, floating, rotary, liquid atomizer as defined in claim 2 wherein said liquid receiving and dispersing means comprises a rotor and said circumferentially spaced-apart holes are located in said rotor, each of said holes being open at the top and bottom thereof and having their longitudinal axis substantially in the vertical direction.

4. A self-propelled, floating, rotary, liquid atomizer as defined in claim 3 wherein said slits in said side wall of said feed tube are configured to be substantially tangential to the circumference of the inside wall surface of said feed tube.

5. A self-propelled, floating, rotary, liquid atomizer as defined in claim 4 wherein said feed tube is directly connected to said pressurized liquid source means.

6. A self-propelled, floating, rotary, liquid atomizer as defined in claim 5 wherein said ball bearing assembly is secured to said closed end of said feed tube by means of a bolt, and is of such a size as to abut said rotor without obstructing said holes located in said rotor.

7. A self-propelled, floating, rotary, liquid atomizer as defined in claim 6 wherein said rotor has portions cut from the periphery thereof in order to substantially reduce the weight of said rotor.

* * * * *